US006010279A

United States Patent [19]

Taylor-Smith

[11] Patent Number: 6,010,279

[45] Date of Patent: Jan. 4, 2000

[54] RETAINING WALL CONSTRUCTION

[76] Inventor: Ernest John Taylor-Smith, 2905 West 37th Ave., Vancouver, Canada, V6N 2T8

[21] Appl. No.: 08/905,484

[22] Filed: Aug. 4, 1997

[51] Int. Cl.[7] ..... E04B 2/18

[52] U.S. Cl. ..... 405/286; 52/582.1; 52/604

[58] Field of Search ..... 405/286, 284; 52/582.1, 604

[56] References Cited

U.S. PATENT DOCUMENTS 4,920,712 5/1990 Dean, Jr. ..... 52/169.4

*Primary Examiner*—William Neuder
*Assistant Examiner*—Tara L. Mayo
*Attorney, Agent, or Firm*—Fulbright & Jaworski L.L.P.

[57] ABSTRACT

A retaining wall construction comprising, in combination, a first block having a hollow interior and opposed side and opposed end walls, a recess formed in at least one of the end walls, and an anchor comprising a generally U-shaped member with a base and sides. The anchor is able to engage the recess with the base extending through the recess and a side extending into the hollow interior of the block. The retaining wall construction of the present invention is very stable and can be assembled to a greater stable height than is possible with conventional retaining walls.

7 Claims, 3 Drawing Sheets

FIG. 1
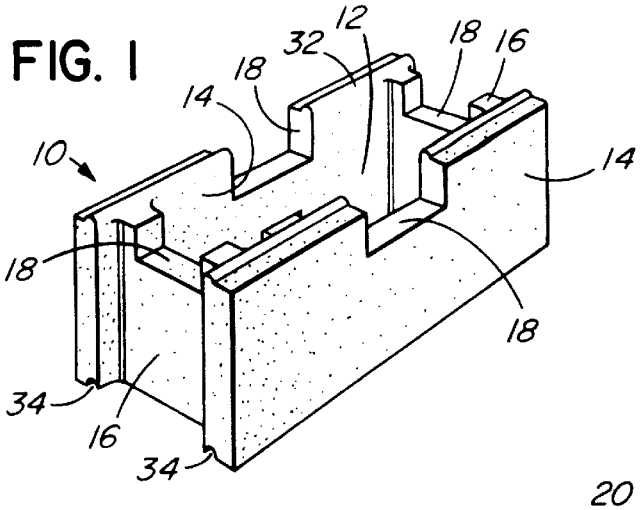
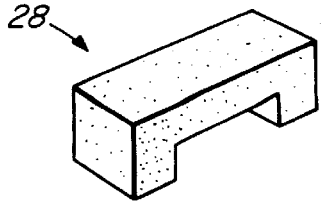
FIG. 2
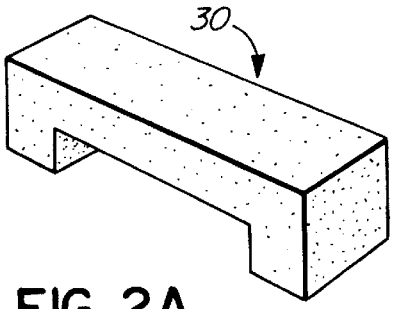
FIG. 2A
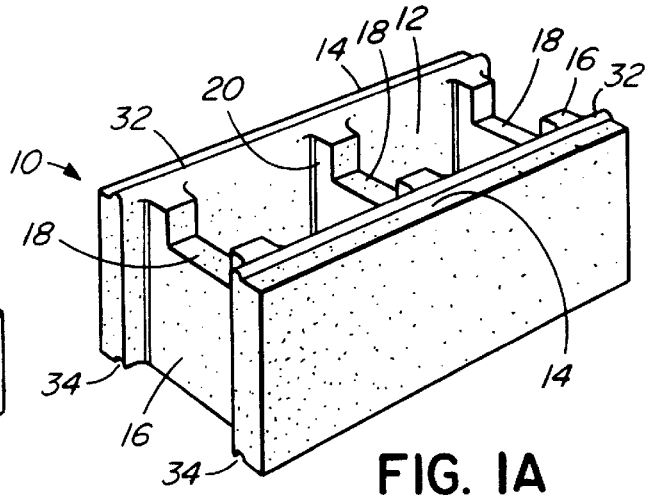
FIG. 1A
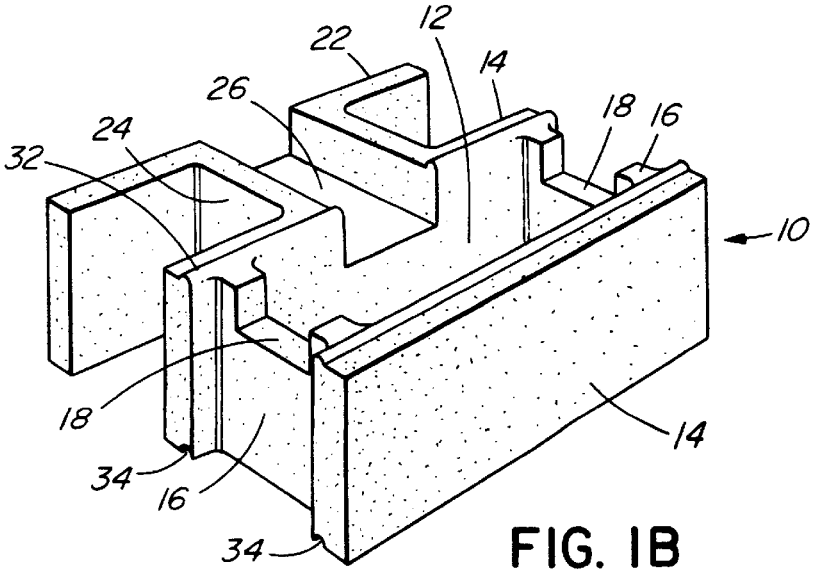
FIG. 1B

RETAINING WALL CONSTRUCTION

This invention relates to a combination useful in wall construction and to a retaining wall produced from the combination.

A retainer wall is a structure that provides lateral resistance to the movement of soil, sand, rocks and the like. The maximum angle from the horizontal that a material can be sloped and remain stable is known as the angle of repose. The angle of repose for a given material can vary depending on the amount of moisture present. To contain material sloped at a greater angle from the angle of repose it is necessary to use a retaining wall.

There are three main types of retaining walls namely, gravity walls, cantilever walls, and counterfort or buttressed walls.

Of these gravity walls derive their stability from their own weight. They are commonly constructed from materials such as stones or concrete blocks, often randomly applied.

Cantilever walls are shaped like an L or an inverted T. The wall is reinforced beginning with horizontal reinforcement in the footing. The reinforcement is then tied to vertical reinforcement in the wall proper. The weight of soil on the base provides resistance to rotation of the wall. Cantilever walls are most often constructed from poured concrete with steel reinforcing bar.

Counterfort or buttressed walls have external vertical reinforcement at regular horizontal intervals along the wall. Walls with the reinforcement behind the walls are counterfort walls, those with the reinforcement in front of the wall are known as buttressed walls.

Retaining walls are usually constructed on a base known as a footing. Typically footings are made from poured concrete, often with reinforcing steel bars.

Retaining walls are usually constructed with drainage so that the water is not trapped in the soil behind the wall. This drainage can be provided by providing either weep holes or a backdrain. A weep hole extends through the wall. A backdrain is a channel running the length of the wall, behind the base of the wall. Perforated pipe is often used for the backdrain. With both types of drainage a layer of porous material, for example gravel, is filled behind the wall at its base during the backfilling process.

Retaining walls can be tied to a slope to prevent them from falling forward. A permanent ground anchor is placed in stable soil or solid rock. A cable or rod is used to connect the anchor to the wall.

It is known to construct retaining walls from blocks. Sheahan in U.S. Pat. No. 4,067,166 disclose a retaining block with a very long bar that extends behind the wall. The block incorporates reinforcing bars. Dean in U.S. Pat. No. 4,920,712 discloses a mortarless retaining wall system. Anchoring is provided by a mat of a grid type material that engages a clip that also engages the blocks. Smith in U.S. Pat. No. 4,990,032 teaches the use of an asymmetrical anchor block with slots to accept metal grid or perforated polymer mats, extending horizontally behind the wall.

Well known retaining wall blocks are marketed under the trademark "Keystone". These blocks have protrusions that extend behind the wall, providing a limited amount of anchoring. However the protrusions are only a few inches long. These blocks also have vertical holes into which plastic pegs are inserted to link the blocks together.

The present invention provides a retaining wall of great stability. It is anchored to the ground in such a way as to provide superior performance to prior art known to applicant.

Accordingly, in a first aspect, the present invention is a combination useful in wall construction and comprising:

a first block having a hollow interior and opposed side and opposed end walls;

a recess formed in at least one of said walls;

an anchor comprising a generally U-shaped member with a base and sides and able to engage said recess with the base extending through the recess and a side extending into said hollow interior of said block.

The block may have a recess on each side wall and in each end wall. In general the depth of the recess is about the same as the thickness of the anchor base. This means that when an anchor is attached to the first block the surfaces of the first block and the anchor are flush.

The invention also provides a combination further including a second block as defined above engaged by the anchor in the same manner as the first block. The anchor thus locks the first and second blocks together.

In a further aspect the block includes a third wall spaced from one of the side walls. There is a bridge joining the third wall and one of said side walls and a channel in the surface of the bridge to receive the base of an anchor.

There may be ridges at one end of the side walls and corresponding channels at the other end of the side walls to engage with the ridges on a neighbouring block.

The invention also provides a retaining wall comprising a plurality of blocks making up a face of the wall and a plurality of blocks behind the face. At least some of the blocks are the first blocks as defined above and at least some of the blocks are the second blocks defined above. The wall includes anchors comprising generally U-shaped members with a base and sides extending between neighbouring blocks.

The invention is illustrated in the drawings in which:

FIG. 1 is an isometric view of a block according to the present invention.

FIG. 1A is an isometric view of a further block according to the invention;

FIG. 1B is an isometric view of a further block;

FIGS. 2 and 2A show anchor members and both drawings are illustrated because, in general, different sizes of anchor will be used in any one wall;

Figure 3:
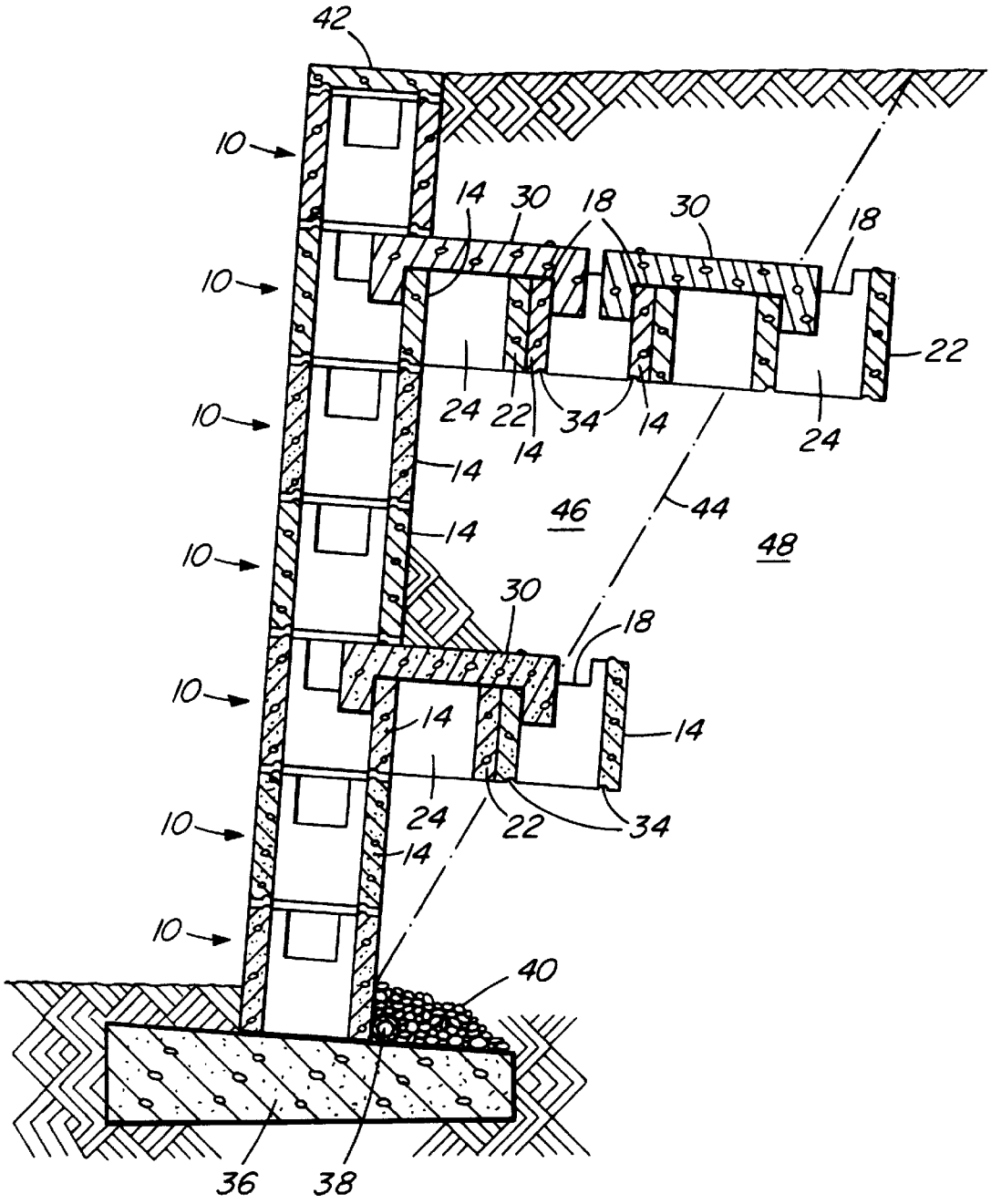
FIG. 3 is side elevation of a wall according to the present invention.

The drawings show a combination useful in wall construction. FIGS. 1, 1A and 1B show a block 10 having a hollow interior 12 with a opposed side walls 14 and opposed end walls 16. FIG. 1 shows a recess 18 formed in each end wall 16 and each side wall 14. FIG. 1A shows a recess 18 in each end wall 16 and also the presence of a center wall 20 again with a recess 18. FIG. 1B shows a block having a third wall 22, spaced from the rear side wall 14. There is a bridge 24 joining the third wall 22 and the adjacent side wall 14.

There is a channel 26 in the upper surface of the bridge24.

The recesses 18 and the channel 26 are to receive anchors 28 and 30 as illustrated in FIGS. 2 and 2A. FIG. 2 shows a small anchor 28, typically for use in linking the recesses 18 in the side walls 14 or end walls 16. FIG. 2A shows a large anchor member 30, typically received in the bridge 24 shown in FIG. 1B.

FIGS. 1 through 1B also show the use of ridges 32 at one end of each side wall 14 and corresponding channels 34 at the other end of said side walls. The ridges 32 and channels 34 engage each other. That is ridges 32 of one block 10 engage in channels 34 in the lower surface of the neighbouring, upper block 10.

FIG. 3 shows a retaining wall constructed according to the present invention using the blocks 10 and anchoring members 30 shown in FIGS. 1 through 2A. In FIG. 3 there is a footing 36, typically of concrete. A drain 38 is shown and gravel 40 or similar porous material. These features are common in the art. The wall illustrated in FIG. 3 is composed of blocks 10 using the reference numerals as shown in FIGS. 1 through 1B and anchoring members 30 as shown in FIG. 2A. The wall also uses a cap 42 to form the top of the wall. The chain line 44 shows a division between unstable soil 46 and stable soil 48.

It will be noted that the blocks 10 of FIG. 1B are used to extend from the front surface of the wall backwards. These blocks 10 may be extended again, for example by the use of blocks 10 as shown in FIG. 1, followed by further blocks 10 as shown in FIG. 1B. The wall is, in the main, made of blocks as shown in FIG. 1A, joined together as necessary by anchoring members 30 as shown in FIG. 2A.

Figure 4:
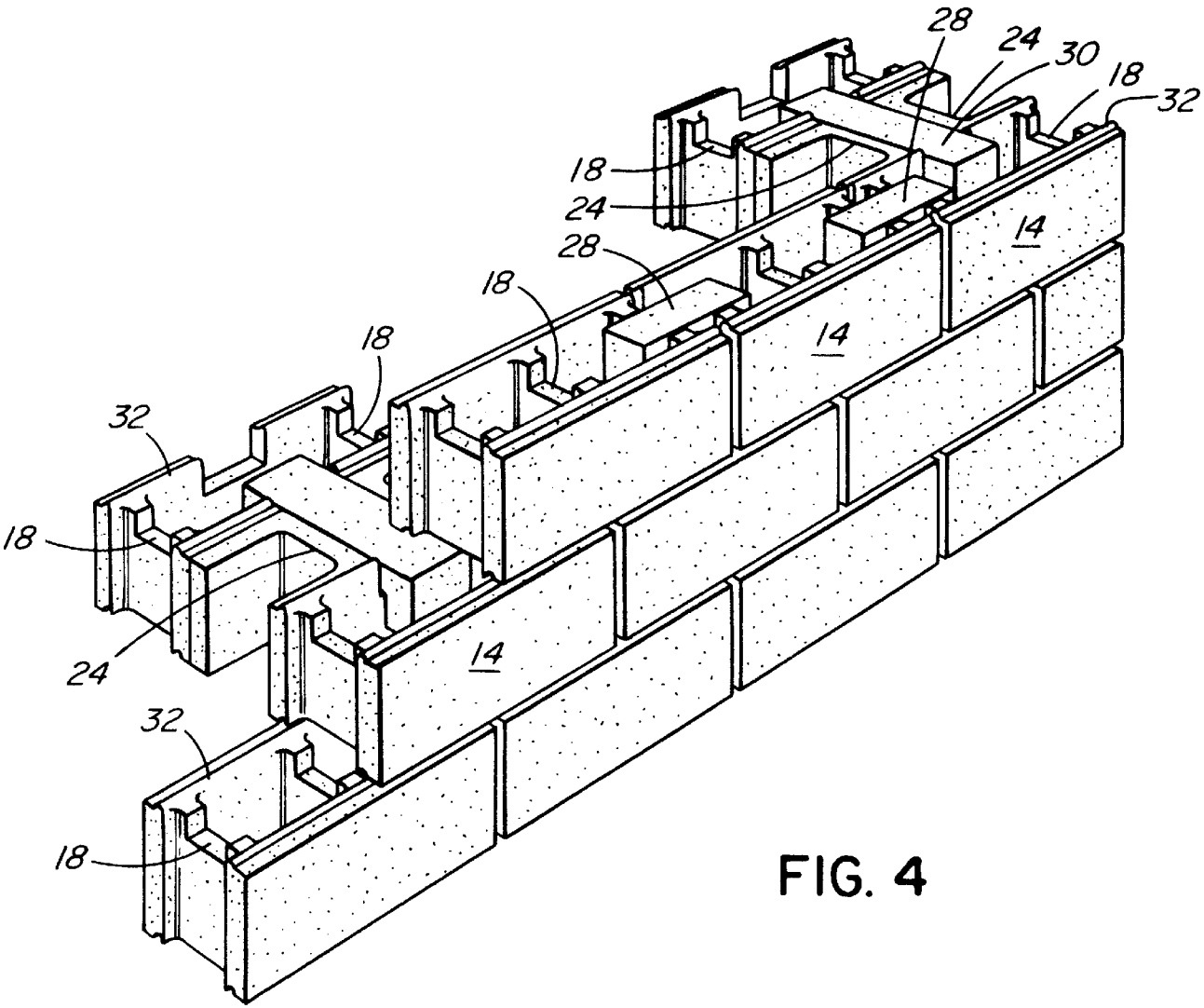
FIG. 4 is an isometric view of a wall according to the present invention.

The use of the anchoring members 28 is shown in FIG. 4 which is an isometric view of a portion of the wall of FIG. 3. It will be appreciated that anchors 28 and 30 and blocks 10 may be added, as required to ensure a fully stable retaining wall is formed.

The blocks 10 according to the present invention may be of concrete or any other desirable material. In general one in five of the blocks used to build a retaining wall according to the present invention will be blocks as illustrated in FIG. 1B.

In general in constructing a retaining wall according the invention soil will be backfilled behind the wall up to the level of a last course of blocks 10. The next course of blocks 10 is then constructed. The caps 42 are laid on the top course. This is conventional in the art.

Mortar may be used, if required. However it is not necessary. The blocks may be provided with embossed or fancy facings or be plain, as shown in the drawings.

The present invention thus allows construction of retaining walls higher than normally possible with the prior art. The anchoring system provides excellent strength. Blocks can be added as necessary in any pattern, until stable ground is reached.

The blocks can be made on automatic concrete block machine, greatly facilitating their production.

Although the present invention has been described in some detail by way of illustration and example for purposes of clarity and understanding, it will be readily apparent to those of ordinary skill in the art in light of the teachings of this invention that certain changes and modifications may be made thereto without departing from the spirit or scope of the appended claims.

I claim:

1. A combination useful in wall construction and comprising:

a first block and a second block, each block having:

opposed side and opposed end walls defining; and a recess formed in at least one of said walls; and an anchor comprising a generally U-shaped member with a base and first and second sides for locking together said blocks by engaging in the recesses of said blocks with the base extending through the recesses and the sides extending into the hollow interior of said blocks.

2. A combination as claimed in claim 1 in which each block has a recess in each side wall and in each end wall.

3. A combination as claimed in claim 1 in which the depth of the recess is about the same as the thickness of the anchor whereby the anchor is flush with the upper surface of the block when extending through the recess.

4. A combination as claimed in claim 1 in which one of said blocks includes a third wall spaced from one of said side walls:

a bridge joining the third wall and said one of said side walls; and a channel in a surface of said bridge to receive the base or an anchor.

5. A combination as claimed in claim 1 including ridges at one end of said side walls;

corresponding channels at the other end of said side walls to engage with the ridges on a neighbouring block.

6. A retaining wall comprising:

a plurality of blocks making up a face of the wall and a plurality of blocks behind the face;

at least some of the blocks being first blocks having opposed side and opposed end walls defining a hollow interior with a recess formed in at least one of the walls;

at least some of the blocks being second blocks having opposed side and opposed end walls defining a hollow interior with a recess formed in at least one of the walls and including a third wall spaced from one of the side walls with a bridge joining the third wall and said one of the side walls having a channel in a surface of the bridge;

a plurality of anchors, each anchor comprising a generally U-shaped member with a base and sides, the anchors for locking together adjacent blocks with the base extending through the recesses of the adjacent blocks and the sides extending into the hollow interiors of the adjacent blocks, and the anchors being adapted to lock together adjacent first and second blocks with the base extending through the recesses and channels of the adjacent first and second blocks and the sides of the anchors extending into the hollow interiors of the adjacent first and second blocks.

7. A retaining wall as claimed in claim 6 in which the second blocks in the face of the wall are oriented such that the third wall of each second block extends rearwardly of the face to permit joining to at least one block behind the face.

* * * * *